United States Patent [19]

Moraru et al.

[11] 4,180,953

[45] Jan. 1, 1980

[54] METHOD AND APPARATUS FOR COUNTERING AN UPWARD CAPILLARY FLOW OF SOIL MOISTURE IN A FOUNDATION WALL

[76] Inventors: Dinu S. Moraru, Str. Sibiel No. 1; Ion Tetcu, B-dul G. Cosbuc No. 93; Constantin Mihaescu, Str. Stefan Furtuna No. 87, all of Bucharest, Romania

[21] Appl. No.: 751,794

[22] Filed: Dec. 17, 1976

[51] Int. Cl.[2] ..... E02D 27/00

[52] U.S. Cl. ..... 52/169.14; 52/741; 52/1

[58] Field of Search ..... 52/169.1, 169.14, 741, 52/742; 61/36 A, 35, 36 R; 252/502; 166/248

[56] References Cited

U.S. PATENT DOCUMENTS

| | | | |
|---|---|---|---|
| 3,070,528 | 12/1962 | Lipcsey | 52/741 |
| 3,962,142 | 6/1976 | Freeman | 252/502 |

FOREIGN PATENT DOCUMENTS

| | | | |
|---|---|---|---|
| 1944435 | 5/1970 | Fed. Rep. of Germany | 52/169.14 |
| 2311729 | 9/1973 | Fed. Rep. of Germany | 52/1 |
| 2337672 | 5/1974 | Fed. Rep. of Germany | 61/36 R |
| 946323 | 1/1964 | United Kingdom | 52/169.14 |
| 1248441 | 10/1971 | United Kingdom | 52/169.14 |
| 1277237 | 6/1972 | United Kingdom | 52/741 |
| 1283775 | 8/1972 | United Kingdom | 52/169.14 |
| 1404059 | 8/1975 | United Kingdom | 52/169.14 |
| 1479653 | 7/1977 | United Kingdom | 52/169.14 |

OTHER PUBLICATIONS

Application of Electrokinetic Phenomena . . . ©2/12/65, vol. 118, Art. 14, pp. 585–602, Annals of the N.Y. Academy of Sciences.

*Primary Examiner*—James A. Leppink
*Assistant Examiner*—Henry E. Raduazo

[57] ABSTRACT

A horizontal array of first elongated electrodes are embedded in a foundation wall above the footing level. A second elongated electrode is embedded in the footing directly below the center line of the first array, and extends diagonally downward in the footing. A rectifier circuit, having an AC input permanently connected to the AC mains, has a positive output terminal connected in parallel to all of the first electrodes and a negative output terminal connected to the second electrode. With such arrangement, the DC current path established when an upward capillary flow of soil moisture reaches the level of the first electrodes is effective to provide a hydrofuge barrier to the capillary flow. Switching means may be associated with the output of the rectifier for alternately switching the positive and negative terminals between (1) alternate ones of the first electrodes, for effecting a drainage operation, and (2) between all of the first electrodes and the second electrode, to effect a barrier to further capillary flow.

8 Claims, 10 Drawing Figures

N 40
35
30
25
20
15
10
5
d = 40 cm.
d = 50 cm.
d = 60 cm.
d = 40 cm
d = 50 cm.
d = 60 cm.
D = 4 cm.
D = 2 cm.
10
15
20
30
45
60
α

METHOD AND APPARATUS FOR COUNTERING AN UPWARD CAPILLARY FLOW OF SOIL MOISTURE IN A FOUNDATION WALL

BACKGROUND OF THE INVENTION

The invention relates to an electrically instrumented technique for drying foundation walls and for preventing their re-wetting.

Certain types of presently known drainage techniques employ an electro-osmotic phenomenon, using rectifiers as a supply source. In general, such techniques require the use of metallic grounds, which are vertically bored into the soil surrounding the footing of the foundation wall to be dried to effect the electro-osmotic drainage of water into the soil. Illustratively, a plurality of tubular, porous and non-metallic electrodes are initially alternately connected to the positive and negative terminals of the rectifier. When a DC current path is completed between adjacent, oppositely-poled ones of the electrodes, moisture is directly released into the atmosphere. In order to avoid subsequent re-wetting, the porous electrodes within the wall are directly connected to the outside metallic ground.

A disadvantage of this latter technique is that the moisture drainage and inhibiting effect is dependent on the physical-chemical characteristics of the soil in which the metallic grounds are disposed.

SUMMARY OF THE INVENTION

These and other disadvantages of known arrangements for countering the effects of soil moisture on foundation walls are avoided with the method and apparatus of the present invention. In an illustrative embodiment, a plurality of distributor electrodes, which may either be solid or tubular, are horizontally embedded in the foundation wall. An oblique collector electrode is embedded in the footing below the distributor electrodes in symmetrical relation thereto. The distributor electrodes are connected to the positive terminal of the rectifier, while the collector electrode is connected to the negative terminal. When the soil moisture has risen by capillary action to the level of the distributor electrodes, a DC current path is established through all of the distributor electrodes and the collector electrode. Because of the positive polarity applied to the distributor electrodes, the wall surface surrounding each distributor electrode bears a charge that is the same as that of the electric charges carried by the soil water during its capillary rise. As a result, a repulsion barrier to the capillary flow is formed.

The rectifier is permanently connected at its input to the AC mains, and is automatically actuated to effect the flow of DC current through the distributor and collector electrodes when the capillary water has reached the plane of the distributor electrode array; the DC current path remains activated until the so-established hydrofuge barrier has stopped the further upward capillary flow.

The rectifier includes a barreter element for limiting and signaling the current amplitude passing through the arrangement. The lighting and extinguishing of the barrier, for example, is indicative of the working and down-time intervals of the installation, while the intensity of light emissions by the barreter is indicative of the degree of wetting of the foundation wall.

For optimum operation, the current density through the capillary flow-inhibiting wall area surrounding each distributor electrode should be greater than $10^{-6}$ amps/cm$^2$. Such effective wall area may be defined by the relation $d \times t$, where d is the distance between successive distributor electrodes in centimeters, while t is the thickness of the foundation wall in centimeters.

In general, the number N representing the distributor electrodes in the array is given by the relation $$((\pi)(D)(J_2))/((K)(d)(\cos \alpha)J_1)$$

where D represents the outer diameter of the distributor electrode in centimeters, $J_1$ is the current density, in amperes/cm$^2$, of the effective capillary flow-inhibiting wall area surrounding each distributor electrode, $J_2$ is the current density, in amperes/cm$^2$, over the cross-section of the collector electrode, such quantity being selected to be not greater than $10^{-4}$ amperes/cm$^2$, $\alpha$ is the angle of declination of the collector electrode with respect to the horizontal, and K is the safety coefficient of the installation, generally equal to 2.

The collector electrode is of cylindrical shape, and illustratively is formed from a mixture containing one part cement to three parts graphite by weight.

BRIEF DESCRIPTION OF THE DRAWING

The invention is further set forth in the following detailed description taken in conjunction with the appended drawing, in which.

DETAILED DESCRIPTION

Figure 2:
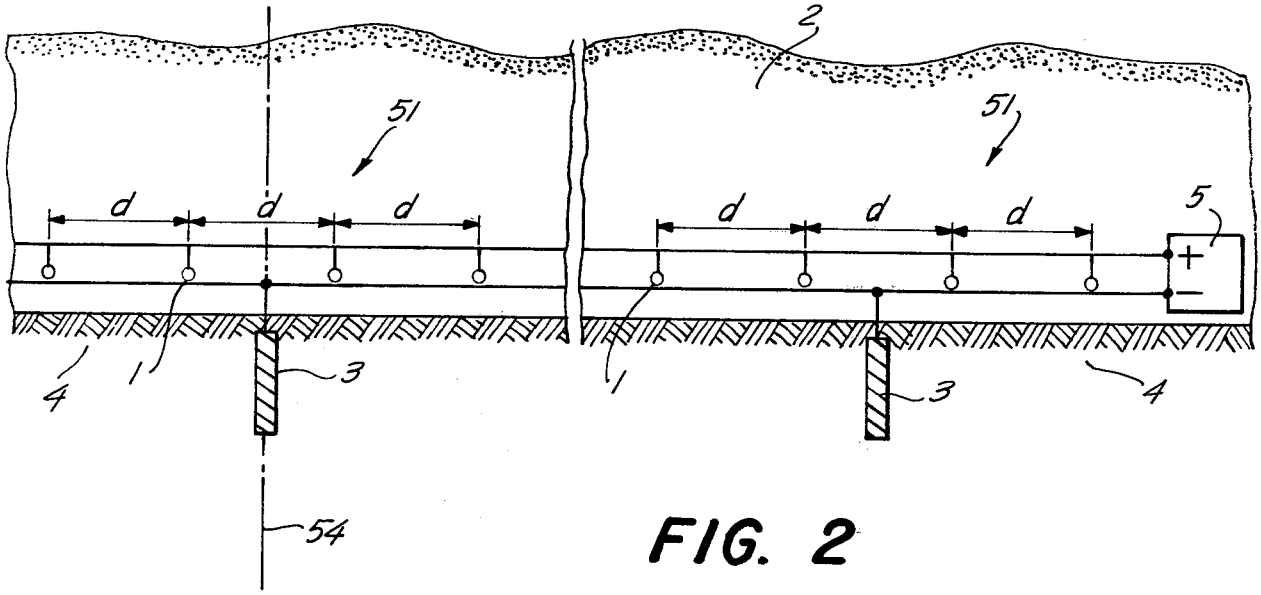
FIG. 2 is a front elevation of the representation of FIG. 1.

Referring now to the drawing, the arrangement in accordance with the invention for countering an upward capillary flow of soil moisture in a foundation wall represented at 2 includes a plurality of distributor electrodes 1 disposed in a horizontal array and embedded in the wall 2, the electrodes 1 individually extending along the thickness dimension t of the wall 2. The electrodes 1 are spaced by a distance d (FIG. 2). The electrodes 1 are cylindrical in shape, and may either be solid or tubular. The external diameter of the electrodes 1 are illustratively in the range of 2–4 cm.

Figure 1:
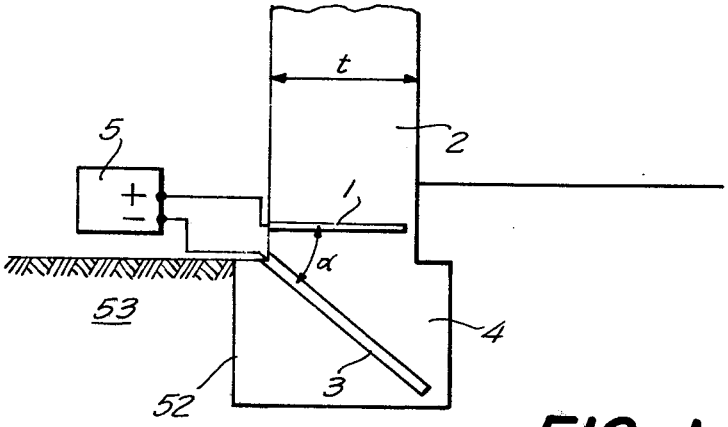
FIG. 1 illustrates an end view of a foundation wall which is connected at its base to a foundation footing and which is associated with an arrangement in accordance with the invention for countering an upward flow of soil moisture through the foundation wall.

The electrodes 1 may be conveniently subdivided into array segments 51 (FIG. 2), each such segment having four of the electrodes 1 corresponding to a collector electrode 3. As indicated best in FIG. 1, the electrode 3 extends diagonally downwardly into a footing 4, which is connected at its top surface with the bottom of the foundation wall 2 and which has a lateral surface 52 abutting the soil, represented at 53. The collector electrode 3 in each array segment defines a declination angle $\alpha$ with respect to the horizontal array segment 51, and extends in a vertical plane 54 that passes substantially symmetrically through the array segment 51. The collector electrode has an external diameter of about 4 cm.

In general, the distance between the distributor electrodes 1 can vary in the range of 30–60 cm, while the thickness of the foundation wall 2 can vary within the range of 25–150 cm.

Figure 5:
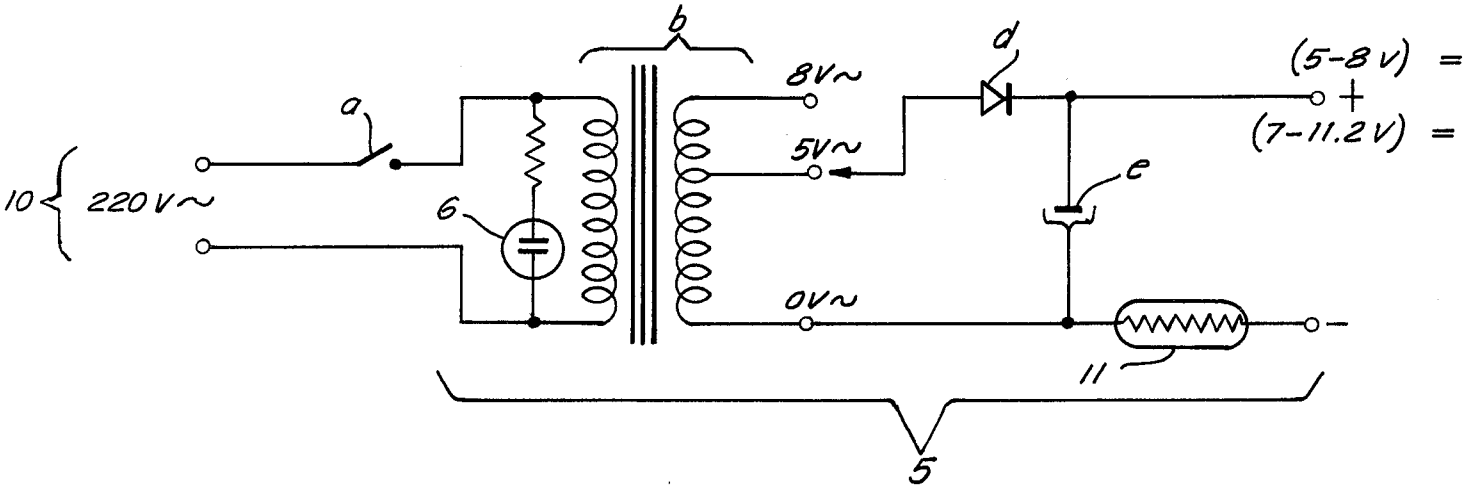
FIG. 5 is a schematic diagram of a rectifier circuit suitable for use in the arrangement of FIG. 1.

An adjustable DC source 5 has a positive output terminal which is connected in parallel to all of the distributor electrodes 1 in the several array segments 51, and a negative output terminal connected to each collector electrode 3. As shown best in FIG. 5, the source 5 can be embodied as a rectifier circuit, having an input permanently connected to standard AC mains 10 through a main power switch 8. The rectifier 5 is illustratively rated at 2.4–3.6 VA, and has a maximum current of 0.3 amperes. Such rating is chosen such that a horizontal area 6, surrounding each of the distributor electrodes 1, will exhibit a positive charge corresponding to the positive polarity of the source 5 to which the associated electrode 1 is connected, with the charge magnitude of such area being sufficient to provide a hydrofuge barrier to an upward capillary flow of soil moisture through such area when the current density through such area is at least equal to $10^{-6} d \times t$ amperes.

The number N of distributor electrodes 1 in each array segment 51 is given by the relation $$((\pi)(D)(J_2))/((K)(d)(\cos\alpha)J_1)$$

where D represents the outer diameter of each distributor electrode 1 in centimeters, $J_1$ represents the above-mentioned current density through the effective capillary flow-inhibiting wall surface 6 corresponding to a distributor electrode 1, where such density is selected to be at least $10^{-6}$ amperes/cm$^2$, $J_2$ is the current density through the cross-section of the collector electrode 3, selected to be not greater than $10^{-4}$ amperes/cm$^2$, and K is the safety coefficient of the overall installation, generally equal to 2.

Figure 6:
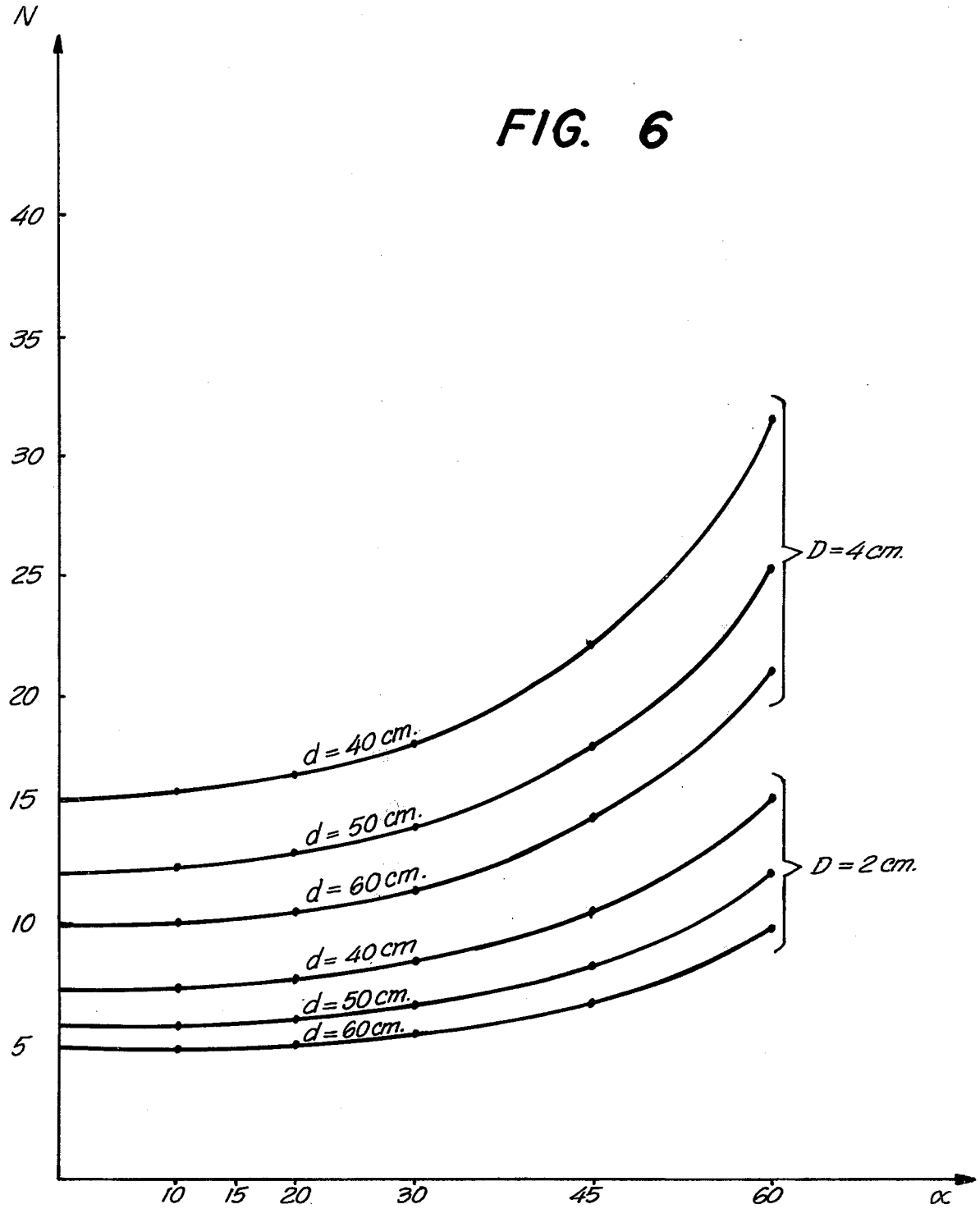
FIG. 6 is a set of curves illustrating the number of distributor electrodes in a typical array of electrodes embedded in the foundation wall in the arrangement of FIG. 1, as a function of the angle of declination of the collector electrode for different spacings between the distributor electrodes.

The curves of FIG. 6 illustrate the variation of N as a function of the declination angle $\alpha$, employing various values of d and D as parameters.

Figure 7:
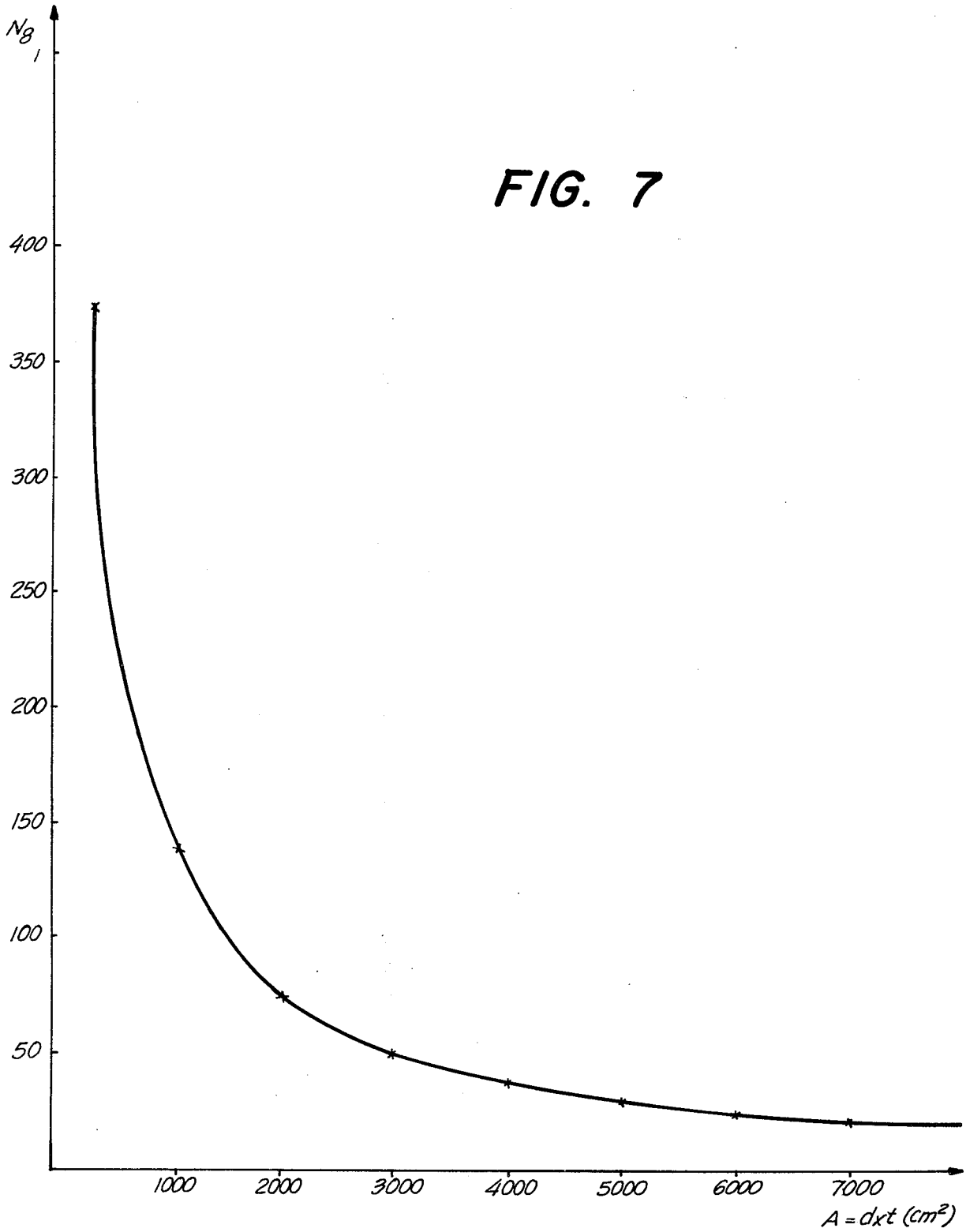
FIG. 7 is a curve illustrating a limitation on the number of distributor electrodes in the array when such electrodes are connected to a standard-output rectifier, as a function of the capillary flow-inhibiting area to be charged by each of such distributor electrodes in the array.

For a given output capacity of the rectifier 5, the number of electrodes that can be connected simultaneously to such source to yield a given capillary flow-inhibiting area 6 for each of such electrodes will decrease as the desired size of the area 6 increases. Such variation between the number (designated $N_G$) of electrodes 1, connectable to the above-mentioned source 5 having an output capacity of 2.4–3.6 VA, and the desired area a of each section 6, is depicted in FIG. 7.

Figure 3:
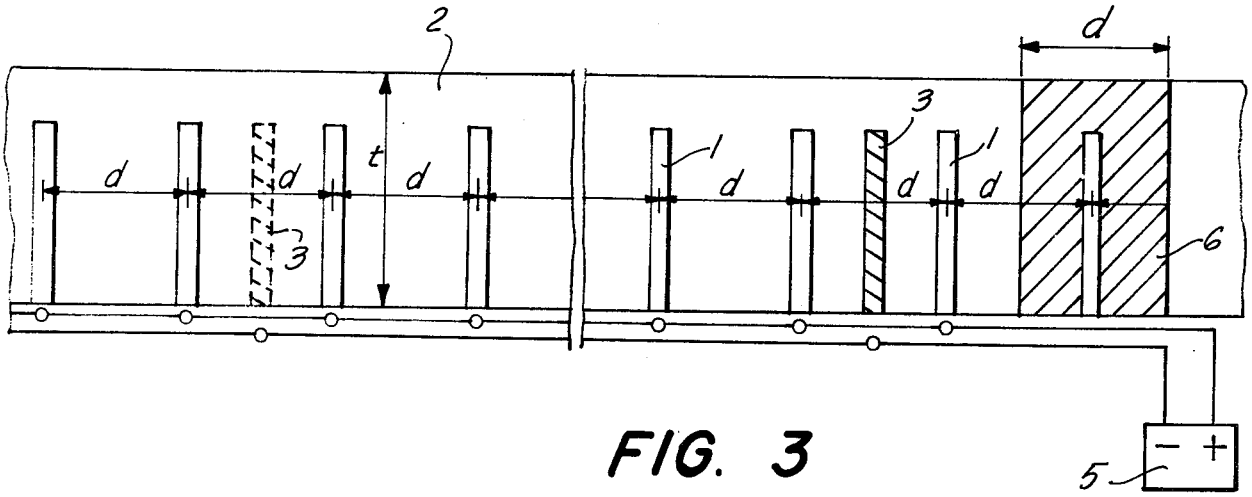
FIG. 3 is a plan view of the representation of FIG. 1.

Certain known techniques in the prior art have employed the excitation of alternate ones of a horizontal array of wall-embedded electrodes as a means of draining soil moisture by electro-osmosis. In further accordance with the invention, the physical arrangement and flow-inhibiting characteristics of the above-mentioned arrangement of FIGS. 1–3 can be combined with such techniques to both drain existing soil moisture from the foundation wall 2 and to inhibit further capillary rise of the moisture. Such combined arrangement is shown in FIG. 8, whereby alternate ones of the distributor electrodes 1 have been renumbered as 7, while the remaining distributor electrodes have been renumbered as 8.

Figure 8:
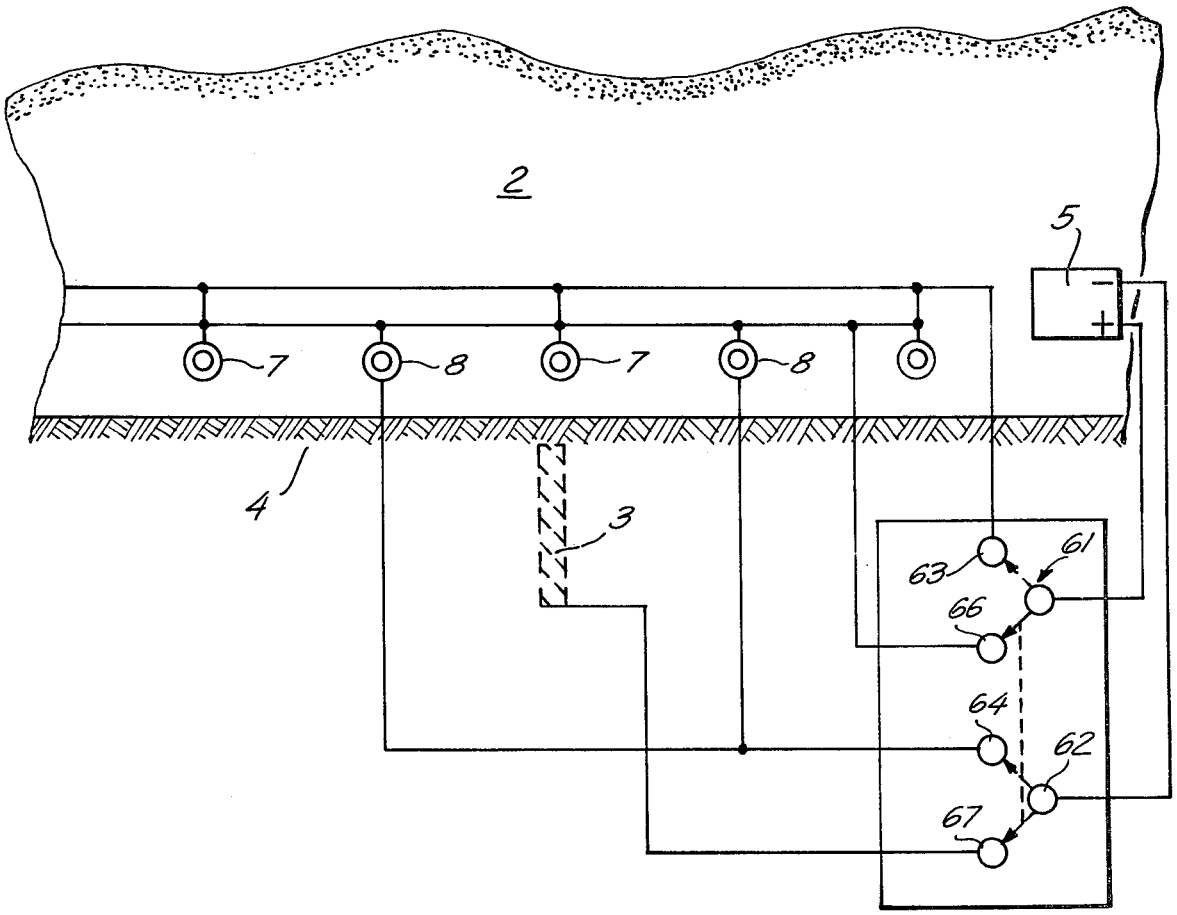
FIG. 8 is a front elevation, similar to FIG. 2, but additionally including a switching element that permits a DC current path to be established either between adjacent ones of the distributor electrodes or between all of the distributor electrodes and the collector electrode.

In the system depicted in FIG. 8, the positive output terminal of the rectifier 5 is connected to a contact terminal of a first switching element 61. The negative output terminal of the rectifier 5 is connected to the contact terminal of a second switch 62, which is ganged with the switch 61 for synchronous movement therewith. A first fixed contact 63 of the switch 61 is connected in parallel to the electrodes 7, while the corresponding fixed contact 64 of the switch 62 is connected to the electrodes 8.

A second fixed contact 66 of the switch 61 is connected to all of the electrodes 7, 8, while the corresponding contact 67 of the switch 62 is connected to the collector electrode 3.

With such arrangement, the placing of the switches 61 and 62 in the top position shown in dotted lines in FIG. 8 will serve to apply opposite polarities of the output of the rectifier 5 to adjacent ones of the distributor electrodes 7, 8, thereby effecting a drainage operation in the manner indicated above. In order to thereafter inhibit further capillary flow as described above in connection with FIGS. 1–3, the switches 61 and 62 can then be placed in the solid-line bottom position shown in FIG. 8, wherein the positive output terminal of the rectifier 5 is connected in parallel to all of the electrodes 7, 8, while the negative output terminal is connected to the collector electrode 3.

Figure 9:
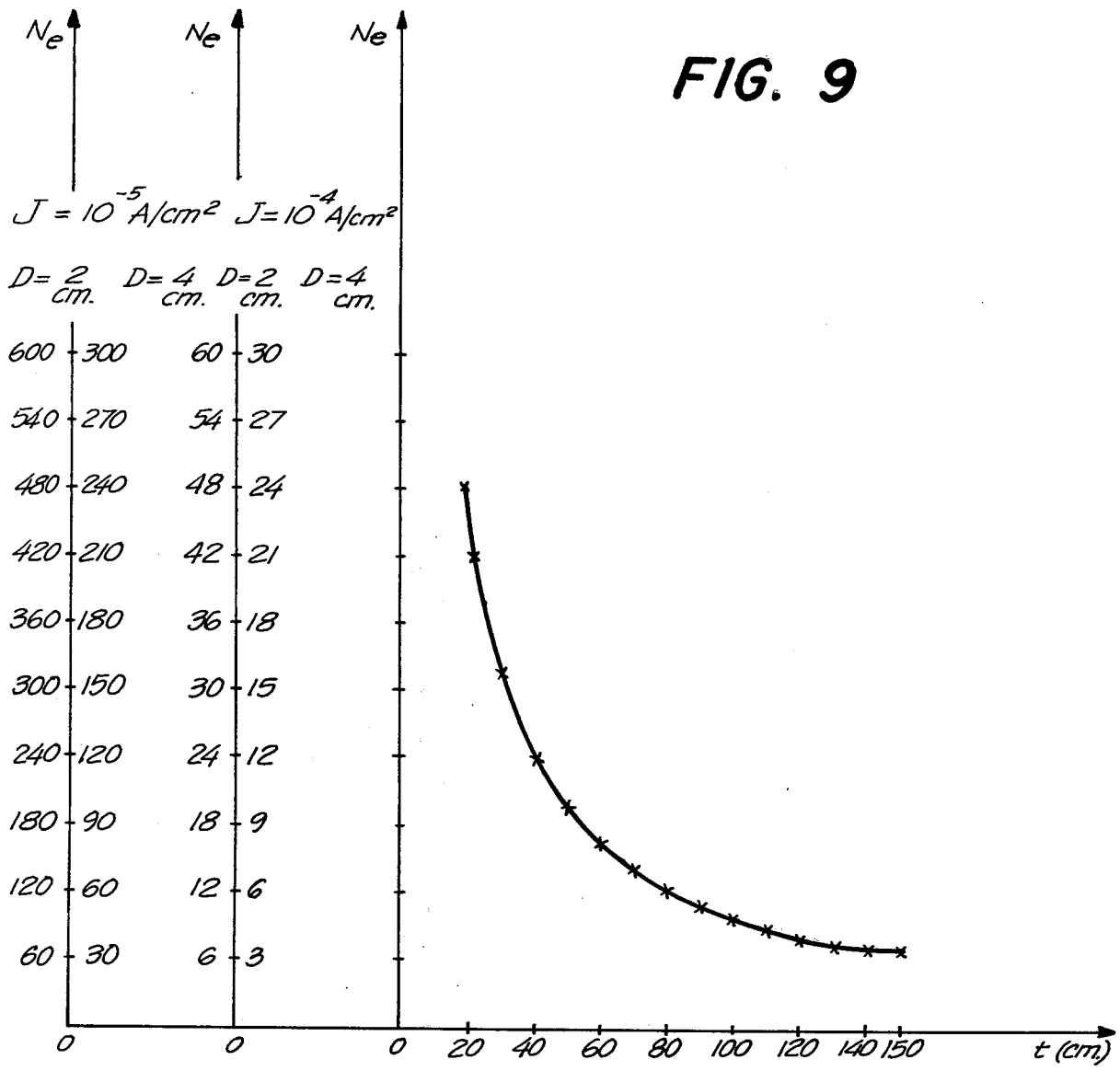
FIG. 9 is a curve illustrating a limitation of the number of distributor electrodes that can be included in an array as a function of the thickness of the foundation wall when only alternate electrodes exhibit the same polarity with the current density in the distributor electrodes being employed as a parameter.

Typically, when the switches 61, 62 in FIG. 8 are in their upper position so that adjacent ones of the electrodes 7, 8 receive opposite polarities, it is advantageous for efficient drainage that the current density through the electrodes 7, 8 be within the range of 0.01–0.1 milliamperes/cm$^2$. In order to estimate the number of electrodes 7, 8 necessary to yield the required drainage effect when such electrodes are connected to a source 5 having the 2.4–3.6 VA capacity, the curve of FIG. 9 is presented. Such figure depicts the total number ($N_e$) of the distributor electrodes connectable to such source 5 as a function of the thickness of the foundation wall 2, using the current density (designated J) through such distributor electrodes and the outer diameter thereof as parameters.

Figure 10:
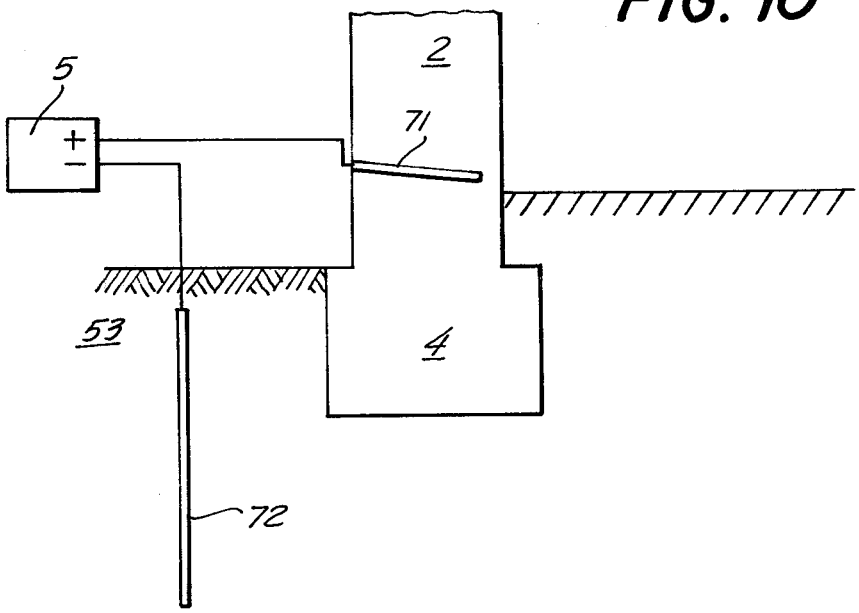
FIG. 10 is an end view, similar to FIG. 1, but illustrating a conventional arrangement of drainage electrodes which can be automatically actuated for capillary flow inhibition in accordance with the invention.

Advantageously, the flow-inhibiting technique of the invention, wherein the rectifier 5 is permanently connected to the AC mains and automatically switched in to effect a barrier-creating DC current flow when the capillary flow height has reached the level of the array of distributor electrodes 1, can be analogously employed in connection with other prior-art drainage electrode systems. One type of such system is shown in FIG. 10. The system includes an array of parallel electrodes 71, analogous to the array of electrodes 1 of FIG. 1, and a metallic grounding terminal 72 which is embedded in the soil 53. The positive terminal of the rectifier 5 is connected to the array electrodes 71 in the wall 2, while the negative terminal thereof is connected to the metallic ground 72; the disposition of the electrode 72 corresponds generally to a declination angle $\alpha$ of 90° for the collector electrode 3 of FIGS. 1–3.

Figure 4:
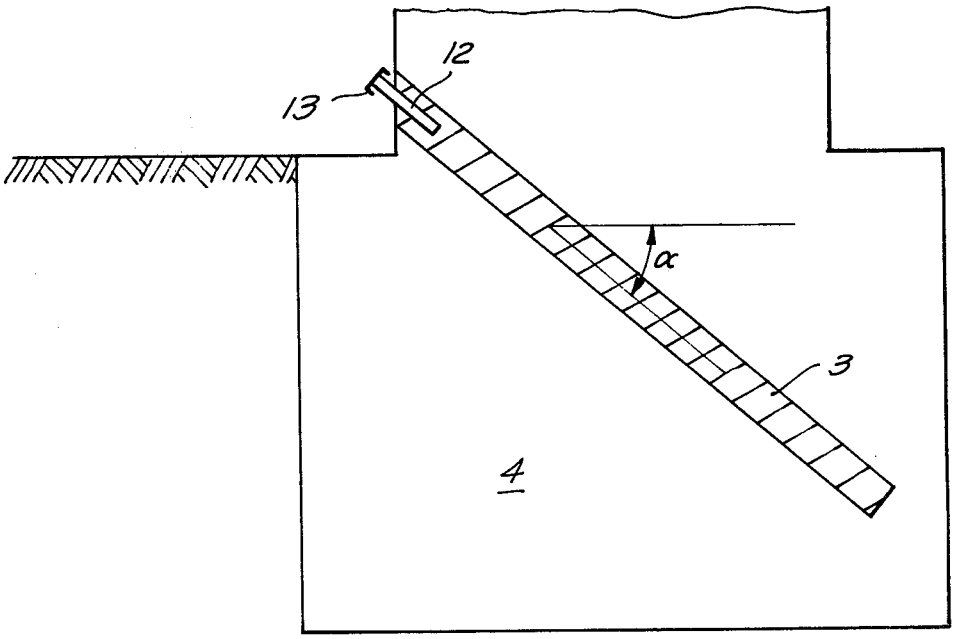
FIG. 4 is an enlarged view of the footing illustrated in FIG. 1, indicating in more detail the orientation and electrical connection of a collector electrode embedded in the footing.

The detailed view of FIG. 4 illustrates the manner in which the collector electrode 3 may be connected to the negative terminal of the source 5. In general, the electrode 3 may be formed from a cement-graphite composition containing one part by weight of cement to three parts by weight of graphite. In order to provide an efficient electrical connection to the source 5, the outer end of the collector electrode 3 has embedded therein a pressed graphite rod which, for the 4 cm diameter of the collector electrode 3 assumed, can have a diameter of about 7 mm and a length of about 100 mm. A metallic plug 13 may be secured to the outer end of the rod 12. The rod 12 may be formed from graphite, or a composition of 34% graphite and 66% phenolic resin of the bakelite type.

Referring again to FIG. 5, the rectifier 5 further includes a transformer b having a voltage ratio of 220:5–8 at 0.3 amps. A pilot lamp c may be associated with the primary winding of the transformer b as shown. The rectifier further includes a diode d, a chemical capacitor e having a typical rating of 500 microfarads/12 volts, and a barreter 11 having a rating of 6.3 volts/0.3 amps. The lighting and extinguishing of the barreter 11 is indicative of the "on" and "off" condition of the flow-inhibiting installation.

In the foregoing, some illustrative arrangements of the invention have been described. Many variations and modifications will now occur to those skilled in the art. It is accordingly desired that the scope of the appended claims not be limited to the specific disclosure herein contained.

What is claimed is:

1. In an electrically instrumented arrangement connectable to an AC supply network for countering an upward capillary flow of soil moisture in the foundation wall of a building joined at its base to a footing that underlies the wall and abuts the soil, the arrangement comprising, in combination, an array of first elongated electrodes each embedded in and extending along the thickness dimension of the wall in parallel spaced horizontal relation, a second elongated electrode embedded in the footing and extending diagonally downwardly in a vertical plane passing substantially symmetrically through the array of first electrodes, rectifier means having an AC input permanently connected to the AC supply network and having respective positive and negative DC output terminals, means for electrically connecting the positive terminal of the rectifier means in parallel to each of the first electrodes, and means for electrically connecting the negative terminal of the rectifier means to the second electrode, whereby when a capillary flow of the soil moisture in the wall extends up to the level of the first electrodes, a DC current path is automatically completed through each of the first electrodes and the second electrode to provide a hydrofuge barrier to the capillary flow of soil moisture, the resulting barrier-producing current flow being automatically maintained until the upward flow of the capillary moisture is terminated.

2. An arrangement as defined in claim 1, in which the rectifier means includes a barreter element.

3. An arrangement as defined in claim 1, in which the second electrode is formed from a cement-graphite composition having a weight ratio of 1:3.

4. An arrangement as defined in claim 1, in which the number (N) of first electrodes in the array is given by the relation $$((\pi)(D)(J_2))/((K)(d)(\cos\alpha)J_1)$$

where D is the external diameter of each first electrode in centimeters, $J_1$ is the current density through the effective capillary flow-inhibiting cross-section ($d \times t$) of each first electrode, d is the distance between successive first electrodes in centimeters, t is the thickness of the foundation wall in centimeters, $J_2$ is the current density in the second electrode, $\alpha$ is the angle of declination of the second electrode to the horizontal, and K is the safety coefficient of the arrangement, which is approximately equal to 2.

5. In an electrically instrumented arrangement connectable to an AC supply network for countering an upward capillary flow of soil moisture in the foundation wall of a building joined at its base to a footing that underlies the wall and abuts the soil, the soil moisture normally tending to flow upwardly in the foundation wall, the arrangement comprising, in combination, an array of first elongated electrodes embedded in the wall, the first electrodes each extending along the thickness dimension of the wall and disposed in horizontally spaced relation above the footing level, a second elongated electrode embedded in the footing and extending diagonally downwardly in a vertical plane passing substantially symmetrically through the array of first electrodes, rectifier means having an AC input connected to the AC supply network and having respective positive and negative DC output terminals, first and second switching means individually associated with the positive and negative terminals of the rectifier means and operable synchronously between respective first and second states, the first switching means being effective when the first state for connecting the positive terminal of the rectifier means to alternate ones of the first electrodes and effective when in the second state for connecting the positive terminal of the rectifier means to all of the first electrodes, the second switching means being effective when in the first state for connecting the negative terminal of the rectifier means to the first electrodes unconnected to the positive terminal when the first switching means is in the first state, the second switching means being effective when in the second state for connecting the negative terminal of the rectifier means to the second electrode.

6. In a method of countering an upward capillary flow of soil moisture in the foundation wall of a building joined at its base to a footing that underlies the wall and abuts the soil, the soil moisture normally tending to flow upwardly in the foundation wall, the foundation wall having embedded therein an array of first elongated electrodes each extending along the thickness dimension of the wall and disposed in horizontally spaced relation above the footing level, the steps of disposing at least one second electrode within the footing with the second electrode extending diagonally downwardly therein in a vertical plane passing substantially symmetrically through the array of first electrodes, and individually connecting the positive and negative output terminals of a DC source to all of the first electrodes and to the second electrode, respectively, whereby when a capillary flow of the soil moisture in the wall has extended up to the level of the first electrodes, a DC current path is automatically completed through all of the first electrodes and the second electrode to provide a hydrofuge barrier to the capillary flow, the resulting barrier-producing current flow being automatically maintained until the capillary moisture flow is terminated.

7. A method as defined in claim 6, comprising the further step of adjusting the source so that the DC current passing through each of the first electrodes to the value at least equal to $10^{-6}(d \times t)$ amperes/cm$^2$, where d is the distance between adjacent first electrodes in centimeters, and t is the thickness of the foundation wall in centimeters.

8. In a method for initially draining a foundation wall subjected to an upward capillary flow of soil moisture and then inhibiting a further upward flow of the moisture, the foundation wall being joined at its base to a footing that underlies the wall and abuts the soil, the foundation wall having embedded therein a plurality of first elongated electrodes each extending along the thickness dimension of the wall and disposed in horizontally spaced relation above the footing level, the footing having embedded therein a second electrode extending diagonally downwardly therein in a vertical plane extending substantially symmetrically through the array of first electrodes, the improvement which comprises the steps of initially connecting the respective positive and negative terminals of a DC source to alternate ones of the first electrodes to effect a drainage operation when moisture is present at the level of the first electrodes, and thereafter re-connecting the respective positive and negative terminals of the DC source to all of the first electrodes and to the second electrode, respectively, to effect a flow-inhibiting operation when moisture has again extended up to the level of the first electrodes.

* * * * *